US009494027B2

(12) United States Patent
Steidl et al.

(10) Patent No.: US 9,494,027 B2
(45) Date of Patent: Nov. 15, 2016

(54) SENSOR-BASED CONTROL OF VIBRATIONS IN SLENDER CONTINUA, SPECIFICALLY TORSIONAL VIBRATIONS IN DEEP-HOLE DRILL STRINGS

(75) Inventors: Michael Steidl, Hamburg (DE); Edwin Kreuzer, Hamburg (DE)

(73) Assignees: TECHNISCHE UNIVERSITAT HAMBURG-HARBURG, Hamburg (DE); TUTECH INNOVATION GMBH, Hamburg (DE)

( * ) Notice: Subject to any disclaimer, the term of this patent is extended or adjusted under 35 U.S.C. 154(b) by 626 days.

(21) Appl. No.: 13/876,835

(22) PCT Filed: Sep. 21, 2011

(86) PCT No.: PCT/EP2011/066419

§ 371 (c)(1),
(2), (4) Date: Jun. 5, 2013

(87) PCT Pub. No.: WO2012/041745

PCT Pub. Date: Apr. 5, 2012

(65) Prior Publication Data

US 2013/0248248 A1 Sep. 26, 2013

(30) Foreign Application Priority Data

Sep. 29, 2010 (DE) ..... 10 2010 046 849

(51) Int. Cl.
*E21B 44/00* (2006.01)

(52) U.S. Cl.
CPC ..... *E21B 44/00* (2013.01)

(58) Field of Classification Search
CPC ..... E21B 44/00; E21B 47/00; E21B 44/04
See application file for complete search history.

(56) References Cited

U.S. PATENT DOCUMENTS 4,965,577 A 10/1990 Baba
4,965,774 A * 10/1990 Ng et al. ..... 367/75

(Continued)

FOREIGN PATENT DOCUMENTS

DE 69102789 T2 1/1995
DE 69926943 T2 7/2006
WO WO-2012/041745 A1 4/2012

OTHER PUBLICATIONS

Berkooz, G., et al., "The Proper Orthogonal Decomposition, Wavelets and Modal Approaches to the Dynamics of Coherent Structures," Applied Scientific Research, vol. 53, pp. 321-338 (Apr. 19, 1994).

(Continued)

*Primary Examiner* — Kipp Wallace
(74) *Attorney, Agent, or Firm* — Wilmer Cutler Pickering Hale and Dorr LLP

(57) ABSTRACT

Control device (100) controlling a drilling operation and methods by which the dynamics of the continuum in question can be divided into superimposed waves, of which the wave traveling in the direction of the actuator and/or drive (10) is compensated by the actuator. This prevents reflection of the energy on the actuator. By using two sensors (30, 40) the wave traveling towards the actuator (10) and the wave traveling away from the actuator (10) can be calculated separately from one another, so that both the parameters of the wave traveling toward the actuator and the parameters of the wave traveling away from the actuator can be determined in order to be able to perform a control of the driving device of the drill string (20) on this basis.

16 Claims, 1 Drawing Sheet

(56) References Cited

U.S. PATENT DOCUMENTS

| | | | | |
|---|---|---|---|---|
| 5,864,058 | A | 1/1999 | Chen | |
| 8,453,764 | B2 * | 6/2013 | Turner et al. | 175/70 |
| 2009/0229882 | A1 | 9/2009 | Quernheim et al. | |

OTHER PUBLICATIONS

International Search Report and Written Opinion issued by the European Patent Office as International Searching Authority for International Application No. PCT/EP2011/066419 dated Jan. 19, 2012 (8 pages).

Jansen, J. D. and van den Steen, L., "Active damping of self-excited torsional vibrations in oil well drillstrings," Journal of Sound and Vibration, vol. 179, No. 4, pp. 647-668 (Jan. 26, 1995).

Kreuzer, E. and Kust, O., "Analysis of long torsional strings by proper orthogonal decomposition," Archives of Applied Mechanics, vol. 67, No. 1, pp. 68-80 (Dec. 1996).

Kreuzer, E. and Steidl, M., "A Wave-Based Approach to Adaptively Control Self-Excited Vibrations in Drill-Strings," Proc. Appl. Math. Mech., vol. 10, pp. 509-510 (May 28, 2010).

O'Connor, William J., "Control of flexible mechanical systems: wave-based techniques," American Control Conference, ACC '07, IEEE, pp. 4192-4202 (Jul. 11-13, 2007).

Tucker, W. R. and Wang, C., "On the Effective Control of Torsional Vibrations in Drilling Systems," Journal of Sound and Vibration, vol. 224, No. 1, pp. 101-122 (Jul. 1, 1999).

Dawson, R., et al., "Drill String Stick-Slip Oscillations," Proceedings of the 1987 Conference of the Society of Experimental Mechanics, 6 pp. (1987).

Halsey, G. W., et al., "Toque Feedback Used to Cure Slip-Stick Motion," Spe Annual Technical Conference and Exhibition, Houston, Texas, 6 pp. (Oct. 2-5, 1988).

Karkoub, M., et al., "Robust 4-synthesis controllers for suppressing stick-slip induced vibrations in oil well drill strings," Multibody Syst. Dyn., vol. 23, pp. 191-207 (2010).

Kreuzer, E., et al., "Control of Torsional Vibrations in Drill-Strings via Decomposition of Traveling Waves," Archive of Applied Mechanics, 18 pp. (2011).

Serrarens, a. F. A., et al., "Hop Control for Suppressing Stick-Slip in Oil Well Drillstrings," IEEE Control Systems Magazine, vol. 18, pp. 19-30 (1998).

Struck, H., et al., "Modellierung, Simulation and aktive Dampfung selbsterregter Schwingungen eines gekrummten Torsionsstranges," Ph. D. Thesis, Technische Universitat Hamburg-Harburg, 163 pp. (2004).

* cited by examiner

SENSOR-BASED CONTROL OF VIBRATIONS IN SLENDER CONTINUA, SPECIFICALLY TORSIONAL VIBRATIONS IN DEEP-HOLE DRILL STRINGS

This application is a U.S. National Phase Application under 35 U.S.C. §371 of International Patent Application No. PCT/EP2011/066419, filed Sep. 21, 2011, which claims the benefit of German Patent Application No. 10 2010 046 849.5, filed Sep. 29, 2010, each of which is hereby incorporated by referenced in its entirety.

SCOPE OF THE INVENTION

The present invention relates to a sensor-based control of vibrations in slender continua, in particular a sensor-based control of torsional vibrations in deep-hole drill strings to prevent torsional vibrations.

BACKGROUND OF THE INVENTION

Vibrations that can be described by the Wave Equation which is often applicable in slender continua. Examples of this include the vibrations of a string, axial vibrations of a rod or torsional vibrations. Long slender continua are especially susceptible to torsional vibrations because of the small ratio of diameter to length, in particular when torques are transferred via the continuum. This occurs in many types of technical equipment, for example, with long drive shafts. A particularly extreme case occurs with deep-hole drill strings used for drilling for gas or oil but also for geothermal projects. The total string reaches lengths of several kilometers so the ratio of diameter to length is often smaller than that of a human hair due to the fact that the outside diameter is only a few centimeters. FIG. 1 shows schematically the structure of a deep-hole drill string. The drill string is driven by a top drive actuator placed on the upper end of the string, for example. The so-called drill bit is located at the lower end of the string, i.e., an industrial diamond-tipped drill bit, which crushes the rock. Strong torsional vibrations, so-called stick-slip vibrations may occur in the string due to torques acting externally along the string, but in particular because of the nonlinear friction characteristic occurring between the rock and the drill bit. These effects are manifested in the drill bit coming to a standstill while the drive continues to rotate at a constant speed. This causes severe twisting of the string until the force on the bit becomes so big that the bit breaks loose again. The speed of the bit after breaking loose often reaches twice the amount of the drive speed and the string is being rotated in the other direction beyond its equilibrium position. As a result the drill bit again comes to a standstill. These vibrations are undesirable because they slow down the drilling operation and result in additional heavy loads on the drill rods.

Controlling these torsional vibrations has long been a topic of research in the field of mechanics. All the approaches so far in an attempt to control torsional vibrations have always been characterized by at least one of the following disadvantages.

On the one hand, measurements along the entire drill string must be available. On the basis of these measurements, the active modes of the drill string dynamics may be determined. Using the resulting modal representation, there are then various approaches for damping the torsional vibrations. Examples from the literature include E. Kreuzer and O. Kust, *Analysis of long torsional strings by proper orthogonal decomposition*, Archive of Applied Mechanics 67 (1996), no. 1, 68-80, and E. Kreuzer and M. Steidl, *A Wave-Based Approach to Adaptively Control Self-Excited Vibrations in Drill-Strings*, published in Proceedings of Applied Mathematics and Mechanics, 2010. In Kreuzer, Steidl, which constitutes the state of the art so far at the Institute of Mechanics and Ocean Engineering, the momentary active modes are converted into traveling waves to compensate the traveling waves at the top drive. To do so, first of all measurements along the entire drill string are necessary, secondly, continuous control is impossible and instead only a feedforward control to stabilize the string is possible. This method is not suitable if the drill string is unstable in the range around the desired target speed.

On the other hand, the dynamics of the drill string is not completely known. Therefore, the control cannot be tailored for the momentary system performance, and accordingly, the methods function better or worse, depending on the actual dynamics. The literature in this regard includes J. D. Jansen and L. Van den Steen, *Active damping of self-excited torsional vibrations in oil well drillstrings*, Journal of Sound and Vibration 179 (1995), 647-668, and R. W. Tucker and C. Wang, *On the effective control of torsional vibrations in drilling systems*, Journal of Sound and Vibration 224 (1999), 101-122. Various sources mention that the so-called "impedance control system" or "soft torque system" presented by Jansen and Van den Steen, which uses measurements of the motor current and motor voltage to implement the characteristic of a passively attenuated vibration absorber with the help of the actuator, is currently in use. The approach presented by Tucker and Wang uses measurements of the "contact torque" between the drill string and the top drive. Some frequencies are absorbed better with this method than others.

Singular disturbances, for example, a wave front caused by breaking loose, could not be controlled with such systems known from the state of the art.

SUMMARY OF THE INVENTION

A major objective of the present invention may be regarded as minimizing vibrations, in particular torsional vibrations, in deep-hole drill strings.

The present invention relates to a sensor-based control of vibrations, a respective method, a computer program and computer-readable memory medium according to the independent claims, and exemplary embodiments are embodied in the dependent claims.

According to an exemplary embodiment of the invention, a control device for sensor-based control of torsional vibrations in a slender continuum is provided, wherein the control device comprises a first input interface for receiving first angular state data, in particular angular velocity data of a first sensor to be connected, a second input interface for receiving second angular state data, in particular angular velocity data of a second sensor to be connected, an output interface for output of a control value to a drive to be connected for a continuum and a control circuit, which is designed to output, based on the Wave Equation and a model for torsional vibrations in a rod, a control value to the output interface based on the first angular state data, in particular angular velocity data and the second angular state data, in particular angular velocity data, as well as the distance between the first sensor to be connected and the second sensor to be connected.

The actuator that can be used for this control may be a top drive motor, which is located at the upper end of the drill string. The cause of the vibrations may lie at the bit or along the string. Thus, for example, the drill bit may be jammed or a location along the drill string may be jammed. Angular state data, in particular angular velocity data is understood to be data allowing a determination of the angular velocity of the drill string at the corresponding sensor location. The data may comprise pulses, for example, resulting from an optical sensor, from which it is possible to deduce the angular velocity, with a given number of pulse generators along the extent of the drill string. In particular a transducer, whose output value allows determination of an angular velocity by integration, may be provided. The angular velocity data may of course also indicate the angular velocity directly, either through a proportional value or a measured value, which has already been evaluated explicitly.

According to an exemplary embodiment of the invention, a control device is made available, such that the control device comprises a first sensor for supplying first measured data and a second sensor for supplying second measured data, the first sensor being connected to the first input interface and the second sensor being connected to the second input interface.

According to an exemplary embodiment of the invention, a drilling tool is made available, having an actuator, the drill drive, a drill string and an inventive control device of the above type for sensor-based control of torsional vibrations in a slender continuum, such that the drill drive is connected to one side of the drill rod for its drive, and the first sensor and the second sensor are arranged on the drill rod at a distance d, such that the drill drive is connected to the output interface of the control device.

Thus only two sensors, both of which are situated close to the actuator, i.e., the drive, are sufficient to detect the relevant dynamics and to stabilize the entire system. Torsional vibrations, in particular stick-slip vibrations, can be controlled more effectively than has been possible in the past. In addition, this method is very inexpensive because only two sensors are necessary and no measurements along the string are required. As a result of this control scheme, the drill string is under fewer load and the drilling can be performed more rapidly. The control concept can be used with any deep-hole drilling systems without requiring a detailed knowledge of the system used.

According to an exemplary embodiment of the invention, a drilling tool is provided, wherein the first sensor and the second sensor are arranged in an area of the drill string which is above the level of the ground.

The sensors remain accessible in this way and the entire measurement and control arrangement can be arranged so that it is readily accessible without having to accept the need for long signal paths. Furthermore, parasitic effects which may occur due to interference between the sensors and the drive can be minimized.

According to an exemplary embodiment of the invention, a drilling tool is made available, wherein the first sensor is arranged at a distance from the drill drive which corresponds essentially to the product of the propagation rate of a torsional vibration wave on the drill string and a control delay of the drill drive, and the second sensor is arranged at a distance d downstream from the first sensor on the string.

A control delay of the actuator can be compensated in this way. The distance may also take into account other delay factors, if necessary. In other words, a control value, for example, has already been output to the actuator control by a real-time control with respect to the upwards-traveling wave when the upwards-traveling wave is still propagating on the section of drill string between the first sensor and the actuator, so that the control intervention affecting the actuator can take place at a point in time very close to the arrival of the wave at the actuator.

According to an exemplary embodiment of the invention, a drilling tool is provided, wherein the drill string is axially movable with respect to the first sensor and the second sensor.

The drill string can be advanced in this way, while the sensors may remain in a stationary fixed position on the derrick with respect to the axial movement of the drill string in relation to the derrick. This is appropriate in particular when the drive, in particular a rotational drive, also remains in a stationary position on the derrick to maintain a constant distance from the sensors, and the drill string is displaced continuously during the rotational drive, for example, due to a following claw arrangement.

According to an exemplary embodiment of the invention, a drilling tool is provided, wherein the drilling tool is a deep-hole drilling tool.

Even in deep drilling, in particular offshore or geothermal drilling, an inventive control may also be implemented in this way.

According to exemplary embodiment of the invention, a method for sensor-based control of torsional vibrations in a slender continuum is made available, comprising the steps of receiving first angular state data, in particular angular velocity data of a first sensor to be connected, receiving second angular state data, in particular angular velocity data of a second sensor to be connected, and output of a control value to a drive to be connected for a continuum on the basis of the first angular state data, in particular angular velocity data and the second angular state data, in particular angular velocity data as well as the distance of the first sensor to be connected from the second sensor to be connected with the help of the wave equation and a model for torsional vibrations in a string.

Although theoretically possible, for cost reasons a measurement along the string is not usually performed and very little data can be transmitted from the output of the string. The external influences causing the torsional vibrations are thus not usually measurable, as well as the current vibrational state along the string is also unknown. The inventive method can absorb all the relevant frequencies and in addition, only a measurement of the angular state data is necessary, in particular the angular velocity data.

According to an exemplary embodiment of the invention, a computer program is provided which, when executed by a processor, is designed to implement the method according to the invention.

According to an exemplary embodiment of the invention, a computer-readable medium is provided on which the computer program according to the invention is stored.

An important idea of the invention is that the dynamics of the continuum in question are divided into two superimposed waves, such that the wave traveling in the direction of the actuator and/or drive is compensated by the actuator. In this way, reflection of the energy on the actuator is prevented and the system behaves as if it were extended to infinity beyond the actuator. By using two sensors, the wave traveling toward the actuator and the wave traveling away from the actuator can be calculated separately so that both the parameters of the approaching wave and the parameters of the departing wave can be determined in order to be able to control the drive of the drill-string on this basis.

It should be pointed out that the embodiments of the invention described below can equally be applied to the device, the method, the computer program and the computer-readable memory medium.

The individual features may of course be combined with one another so that advantageous effects which go beyond the sum of the individual effects can also be achieved in some cases.

These and other aspects of the present invention are explained and illustrated by the reference to the exemplary embodiments described hereinafter.

BRIEF DESCRIPTION OF THE DRAWINGS

Exemplary embodiments are described below with reference to the accompanying drawings.

DETAILED DESCRIPTION OF EXEMPLARY EMBODIMENTS

Figure 1:
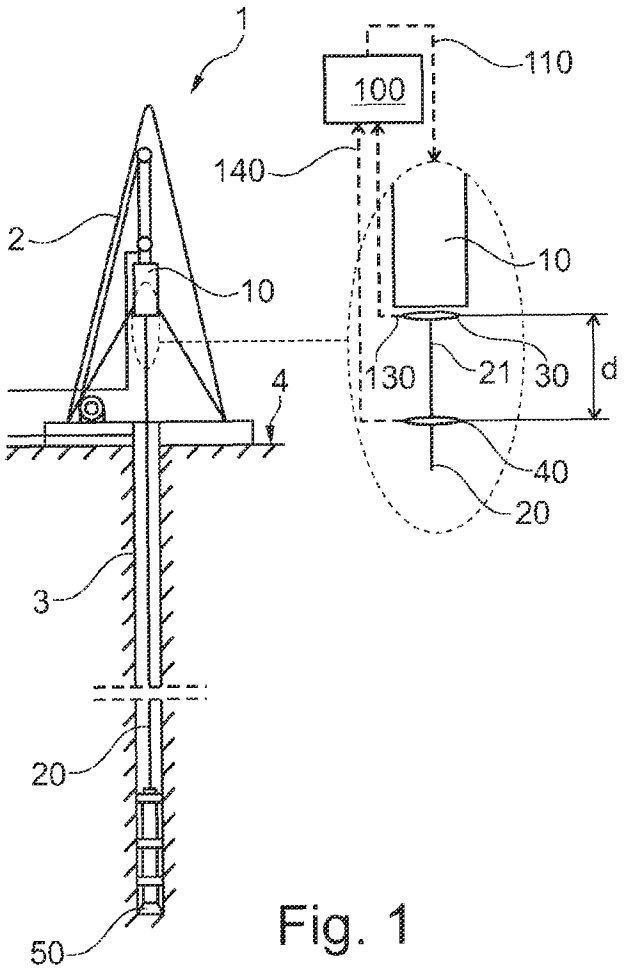
FIG. 1 illustrates a basic design of a drilling device consisting of a drill string, sensors and a drive.

FIG. 1 illustrates a general design of a drilling device consisting of a drill string, sensors and a drive. The device for drilling 1 shown in FIG. 1 has a derrick 2 on which an actuator, the drill drive 10 is provided, with which a drill string 20 can be driven to turn a drill head 50, also known as a bit, attached to the other end of the drill string 20, which is situated in the drill hole 3. The upper region is shown again in enlarged form in FIG. 1. The drill drive 10, for example, an electric motor, drives the drill string 20 on which sensors are arranged, namely two sensors 30, 40 here. These sensors 30, 40 serve to determine measured variables which allow a determination of the angular state data, in particular the angular velocity of the drill string 20 at the corresponding sensor position. The sensors are arranged at a distance d from one another with a drill string region 21 in between. The sensors deliver their corresponding measurement signals over corresponding signal lines 130, 140 to a control 100. In the control 100 the measurement signals are evaluated to deliver a control signal via a control signal line 110 to the drill drive 10 on the basis of these signals.

Figure 2:
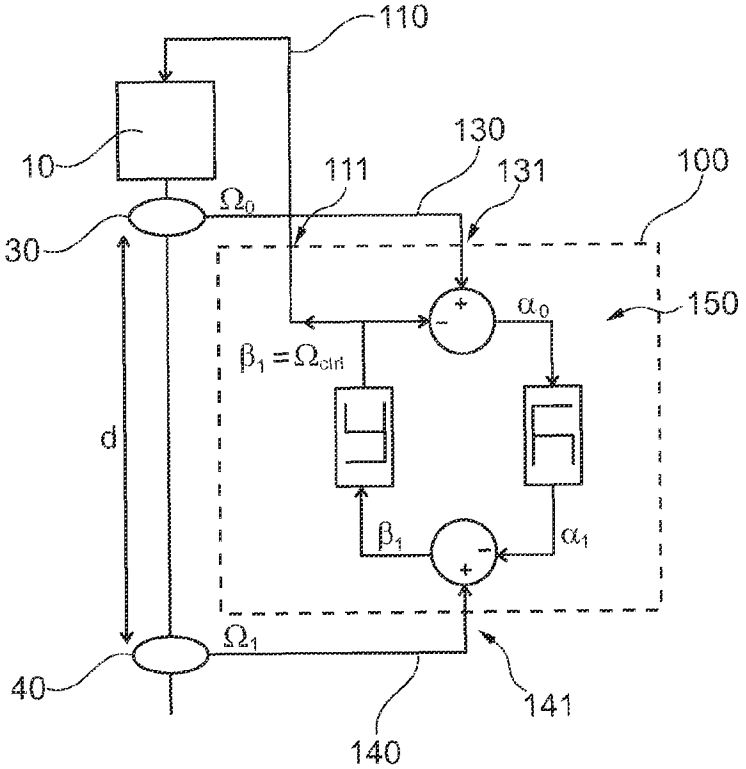
FIG. 2 illustrates a control circuit of a dynamic system for calculating traveling vibrational waves.

FIG. 2 illustrates a control circuit 100 of a dynamic system for calculation of traveling vibration waves. The control device 100 illustrated in FIG. 2 comprises a first input interface 131 for receiving first angular state data, in particular angular velocity data of a first sensor which is to be connected, a second input interface 141 for receiving second angular state data, in particular angular velocity data of a second sensor which is to be connected and an output interface 111 for output of a control value to a drive for a continuum and/or a drill string which is to be connected. The interfaces are linked to a control circuit 150, which is designed to output a control value to the output interface 111 on the basis of the first angular state data, in particular angular velocity data, and a second angular state data, in particular angular velocity data, as well as the distance of the first sensor 30 from the second sensor 40 with the help of the wave equation and a model for torsional vibrations in a rod. Then the motor and/or actuator 10 can be controlled using this control value, for example, an angular velocity.

The drilling tool 1 having a drill drive 10, a drill string 20 and the control device for sensor-based control of torsional vibrations in a drill string and/or a slender continuum has the first sensor 30 and the second sensor 40 on the drill string 20 with a distance d, such that the drill drive 10 is linked to the output interface 111 of the control device 100. The first sensor 30 and the second sensor 40 are arranged in an area of the drill string 20 which is situated above ground level 4, so that these are accessible. The distance d should be at least as great as the quotient of the wave velocity of the vibrational wave on the drill string and the sampling rate. At a sampling rate of 1000 Hz and a wave velocity of 2000 m/s, the distance should thus be at least 2 meters. The higher the sampling rate, the smaller may be the spacing of the sensors. If the first sensor is arranged at a distance from the drill drive 10, which corresponds essentially to the product of the propagation rate of a torsional vibration wave c on the drill string 20 and a control delay of the drill drive 10, and the second sensor 40 is arranged at a distance d downstream from the first sensor, then the transit time delay of the accelerating wave until reaching the drive may just compensate its control delay. In designing the distance of the first sensor from the drive, other delay variables may of course also be included. The drill string may be movable axially with respect to the first sensor 30 and the second sensor 40, for example, by applying pulse generators running axially or other position markers to the drill string, extending axially.

The evaluation will be explained later, in particular with reference to FIG. 2 where the same reference numerals denote the same or similar elements.

On the basis of FIGS. 1 and 2, the theoretical principles for the inventive control device and the respective method are described below, showing how the dynamics of a slender continuum described by the wave equation (e.g., a drill string), in particular unwanted vibration, can be decomposed into waves traveling in two opposite directions on the basis of two sensors. With this decomposition, it is possible to design a control method which compensates for the wave traveling in the direction of the actuator situated at the end of the system. In this way a reflection of the wave into the system is prevented, and a large portion of the energy is withdrawn from the unwanted vibrations. At the same time it is irrelevant here how the vibrations in the system are caused and whether one or more modes of the system are excited. In addition, the sensors may be mounted very close to the actuator although the control method stabilizes the entire system. With the control method described here, both of the problems mentioned above can be solved. Measurements along the string are no longer needed, but at the same time the dynamics relevant for the control method can be calculated accurately from the two sensors mounted very close to the drive. Accordingly, the control method fits the current system behaviour exactly. In the case of the drill string, the loads that occur along the string are usually unknown and are highly variable in the course of the drilling operation, so it is of crucial importance that the controller adapts to the momentary system behaviour. For the case of a drill string, two sensors are needed to measure the torsion angle and/or the angular velocity of the string directly on the drive as well as a small distance below the drive (e.g., 2 meters) (cf. detail in FIG. 1). The two measurement points are located above the ground area and are therefore readily accessible.

The idea of the control method is based on the fact that the rate of propagation of torsional waves is infinite. In addition, the rate of propagation is independent of the frequency of the wave in question. The torsional vibrations in a rod are described by the wave equation:

$$(\delta\hat{}2\phi(x,t))/(\delta t)\hat{}2=c\hat{}2(\delta\hat{}2\phi(x,t))/(\delta x)\hat{}2. \quad (1)$$

The general solution of the wave equation is $$\phi(x,t)=f(x-ct)+g(x+ct), \quad (2)$$

where $\phi(x, t)$ is the torsion angle as a function of the length coordinate x, parameter c is the wave propagation velocity in the material. It holds that c^2=G/p, where G is the shear modulus and $\rho$ is the density of the material.

Let the length of the structure in question be le, and the short section 0<x<1 of the structure shall be considered below and in addition: le>1. It is assumed that there are no externally acting torques within the section in question. In addition, the measurement of the rotational rate $\Omega(x=0)=\Omega 0$ should be at the point x=0, and the measurement of the rotational speed $\Omega(x=1)=\Omega 1$ should be at the point x=1. The sensor spacing d is selected here to be 1. However, through appropriate scaling, all other spacings d are also possible. The measurements are assumed to be available continuously and free of noise. These measurements may be interpreted as time-dependent boundary conditions of the section in question. In addition, the parameter $\tau$ is defined, such that $$c\tau=1 \text{ and/or } \tau=1/c \tag{3}$$

i.e., $\tau$ corresponds to the propagation time of the wave between the two measurement points. Starting from the general solution and by definition of velocity waves $$\alpha := -\frac{\partial}{\partial t}(x-ct) \text{ and } \beta := \frac{\partial}{\partial t}$$

(kann das auch im deutschen Text noch berücksichtigt werden?)(x+ct) (inserting the general solution into the time-dependent boundary conditions):

$$\Omega 0(t)=\alpha(-ct)+\beta(+ct), \tag{4}$$

$$\Omega 1(t)=\alpha(1-ct)+\beta(1+ct). \tag{5}$$

Based on the known propagation rate, the following relationships hold with equation (3):

$$\alpha(1-ct)+\alpha(-c(t-\tau)), \tag{6}$$

$$\beta(c(t-\tau))=\beta(1+c(t-2\tau)). \tag{7}$$

Equation (4) with equation (7) yields:

$$\Omega 0(t-\tau)=\alpha(-c(t-\tau))+\beta(1+c(t-2\tau)). \tag{8}$$

This in turn yields $$\alpha(-c(t-\tau))=\Omega 0(t-\tau)-\beta(1+c(t-2\tau)). \tag{9}$$

If one now considers the equation for $\Omega 1(t)$, this yields with equation (6)

$$\Omega 1(t)=\alpha(1-ct)+\beta(1+ct)=\alpha(-c(t-\tau))+\beta(1+ct). \tag{10}$$

By inserting equation (9) in (10), this finally yields $$\Omega 1(t)=\Omega 0(t-\tau)-\beta(1+c(t-2\tau))+\beta(1+ct). \tag{11}$$

This shows that $\beta(1+ct)$ can be calculated as a function of the two measured values $\Omega 0$ and $\Omega 1$ as well as its state in the past by $2\tau$:

$$\beta(1+ct)=\Omega 1(t)-\Omega 0(t-\tau)+\beta(1+c(t-2\tau)). \tag{12}$$

If the initial values are known, e.g., because the system is started from a resting position, $\phi(x, 0)=0$ and $\Omega(x, 0)=0$, this yields $$\alpha(x=0,t=0)=0, \tag{13}$$

$$\alpha(x=1,t=0)=0, \tag{14}$$

$$\beta(x=0,t=0)=0, \tag{15}$$

$$\beta(x=1,t=0)=0. \tag{16}$$

Accordingly, $\alpha(x=0, t)$, $\alpha(x=1, t)$, $\beta(x=0, t)$ and $\beta(x=1, t)$ can be determined using the measurements $\Omega 0$ and $\Omega 1$.

In order to calculate the variables being sought, the dynamic system illustrated in FIG. 2 is obtained from the above equations. The two transfer terms shown in the drawing are delay elements here with the delay T. For simplification the following hold:

$$\alpha(x=0,t)=\alpha 0,$$

$$\alpha(x=1,t)=\alpha 1,$$

$$\beta(x=0,t)=\beta 0,$$

$$\beta(x=1,t)=\beta 1.$$

This system is simulated with the two measured angular velocities $\Omega 0$ and $\Omega 1$ as input in a real time computer. Real time is understood here to refer to boundary conditions in which a loop run-through of a control and/or regulating method is shorter than two successive sampling values of a sampling rate. The accelerating wave $\beta 0=\Omega ctrl$ is then used to control the target velocity of the actuator and is thereby compensated in the actuator and thus energy is withdrawn from the vibrations.

In the case of the drill string, the system is regulated not with respect to the speed zero but instead with respect to a fixed rotational speed, which is to be adapted by the operator of the plant to the prevailing situation. Accordingly, the unwanted torsional vibrations do not occur around the speed zero but instead around the desired rotational speed. The signal generated by the system described above is therefore filtered with the help of a high pass filter having a very low cutoff frequency so that the control system can be used for various rotational speeds and/or may also be used for switching between two rotational speeds. In addition, the system described in the theory part for continuously available sensor signals is necessarily discretized in implementation in the real system, i.e., the sensor data is available only at discrete instants in time. This may lead to very high frequency noise in the dynamic system described here, but this can easily be filtered out by using a suitable low-pass filter with a very high cutoff frequency. The frequency range relevant for the dynamics of the drill string remains unaffected by the filters and completely preserved.

A functional embodiment may have a drill string, for example, which may be embodied by a drill string model having a length of 10 meters, for example. Angle sensors having an interpolated resolution of 25 bits and/or a physical resolution of 12 bits may be used as the sensors. The control may be implemented in software on a PC using a Quad-Core processor and Lab View RealTime.

It should be pointed out that the present invention may also be used with other drive geometries in which torsional vibrations are to be expected in addition to being used in deep-hole drilling technology.

It should be pointed out that the term "comprise" does not rule out additional elements or method steps, nor does the term "a" or "an" rule out the use of multiple elements and steps.

The reference numerals used here serve only to increase comprehension and should by no means be considered to be restrictive, such that the scope of protection of the invention is reflected by the claims.

LIST OF REFERENCE NUMERALS

1 Drilling device
2 Derrick

3 Drill hole
4 Ground level
10 Drill drive
20 Drill string
21 Drill string range
30 First sensor
40 Second sensor
50 Drill head, bit
100 Control
110 Trigger signal line
111 Output interface
130 First measurement signal line
131 First input interface
140 Second measurement signal line
141 Second input interface
150 Control circuit
d Distance d

The invention claimed is:

1. A drilling tool having
a drill drive,
a drill string, and
a control device for sensor-based control of vibrations, wherein the control device comprises:
a first input interface for receiving first angular state data, connected to a first sensor,
a second input interface for receiving second angular state data, connected to a second sensor,
an output interface for output of a control value to the drill drive to be connected for a continuum,
a control circuit, which is designed to output the control value to the output interface on the basis of the first angular state data, and the second angular state data, as well as the distance of the first sensor from the second sensor derived from a wave equation, and
wherein the first sensor is spaced at a distance from the drill drive which is substantially equal to the product of the rate of propagation of a torsional vibration wave c on the drill string and a control delay of the drill drive, and the second sensor is spaced at a distance d downstream from the first sensor.

2. The drilling tool according to claim 1, wherein the control device comprises the first sensor for supplying a first measured data and the second sensor for supplying a second measured data, wherein the first sensor is linked to the first input interface and the second sensor is linked to the second input interface.

3. A drilling tool according to claim 1,
wherein the drill drive is linked to one side of the drill string for driving the drill drive,
wherein the first sensor and the second sensor are spaced on the drill string at a distance d,
wherein the drill drive is linked to the output interface of the control device.

4. The drilling tool according to claim 1, wherein the first sensor and the second sensor are arranged in a region of the drill string which is above ground level.

5. The drilling tool according to claim 1, wherein the drill string is movable axially with respect to the first sensor and the second sensor.

6. The drilling tool according to claim 1, wherein the drilling tool is a deep-hole drilling tool.

7. The drilling tool of claim 1 wherein the first angular state data includes angular velocity data.

8. The drilling tool of claim 1 wherein the second angular state data includes angular velocity data.

9. The drilling tool of claim 1 wherein the wave equation includes a model for torsional vibrations.

10. The drilling tool according to claim 1, wherein the drill string is movable axially with respect to the first sensor and the second sensor.

11. A method for sensor-based control vibrations having:
providing a drill drive,
providing a drill string,
receiving of first angular state data, from a first sensor,
receiving of second angular state data from a second sensor,
outputting of a control value to a drive that is connected to a continuum on the basis of the first angular state data and the second angular state data, as well as the distance between the first sensor from the second sensor, derived from a wave equation,
arranging of the first sensor at a distance from the drill drive which is substantially equal to the product of the rate of propagation of a torsional vibration wave c on the drill string and a control delay of the drill drive, and
arranging of the second sensor at a distance d downstream from the first sensor.

12. A computer program which when executed by a processor is designed to execute the method according to claim 11.

13. A computer-readable medium on which the computer program according to claim 12 is stored.

14. The method of claim 11 wherein the first angular state data includes angular velocity data.

15. The method of claim 11 wherein the second angular state data includes angular velocity data.

16. The method of claim 11 wherein the wave equation includes a model for torsional vibrations.

* * * * *